US005758993A

United States Patent [19]

Schmednecht et al.

[11] Patent Number: 5,758,993

[45] Date of Patent: Jun. 2, 1998

[54] METHOD AND APPARATUS FOR FORMING SUCCESSIVE OVERLAPPING VOIDS IN THE GROUND ALONG A PREDETERMINED COURSE OF TRAVEL AND FOR PRODUCING A SUBTERRANEAN WALL THEREIN

[75] Inventors: Eric J. Schmednecht; Fred C. Schmednecht, both of Valparaiso, Ind.

[73] Assignee: Slurry Systems, Inc., Gary, Ind.

[21] Appl. No.: 661,814

[22] Filed: Jun. 11, 1996

[51] Int. Cl.[6] ..... E02D 5/20

[52] U.S. Cl. ..... 405/267; 405/274; 405/232; 405/248

[58] Field of Search ..... 405/232, 274, 405/282, 267, 231, 276–281, 269, 128, 240

[56] References Cited

U.S. PATENT DOCUMENTS

| | | | |
|---|---|---|---|
| 745,453 | 12/1903 | McBean | 405/274 |
| 2,952,130 | 9/1960 | Mueller | 405/267 X |
| 3,416,322 | 12/1968 | Bodine | 405/267 |
| 3,782,125 | 1/1974 | Holl | 405/282 |
| 3,822,557 | 7/1974 | Frederick . | |
| 3,973,408 | 8/1976 | Paverman | 405/267 |
| 4,057,969 | 11/1977 | Rochmann . | |
| 4,249,836 | 2/1981 | Schmednecht . | |
| 4,585,678 | 4/1986 | Kunito . | |
| 4,664,560 | 5/1987 | Cortlever . | |
| 5,007,770 | 4/1991 | Simmons et al. . | |
| 5,141,364 | 8/1992 | Degen et al. . | |
| 5,240,348 | 8/1993 | Breaux | 405/267 X |
| 5,403,125 | 4/1995 | Andersen | 405/267 |
| 5,584,610 | 12/1996 | Simpson et al. | 405/274 X |

*Primary Examiner*—Dennis L. Taylor
*Attorney, Agent, or Firm*—Leydig, Voit & Mayer, Ltd.

[57] ABSTRACT

A method and an apparatus is provided for forming successive overlapping voids in the ground along a predetermined course of travel and for producing a subterranean wall therein. The apparatus includes a mandrel for forming voids in the ground, and a pattern guide templet having repeating contours arranged on the ground for accurately guiding the mandrel along the predetermined course of travel during successive mandrel insertions. The mandrel includes a plurality of downwardly projecting spaced-apart cutting teeth for facilitating penetration of the mandrel into the ground, and a plurality of downwardly projecting high pressure nozzles for discharging an injectable material (e.g., slurry material or water) into the ground as the mandrel is inserted therein. The repeating contours of the pattern guide templet accurately receive and accommodate the cross-sectional shape of the mandrel during successive mandrel insertions so that successive overlapping voids are formed in the ground along the predetermined course of travel. The apparatus of the present invention further includes an installation rig for inserting structural elements into the successive overlapping voids formed by the mandrel. In this way, a subterranean wall comprised of liquid impervious slurry material and/or contiguous structural elements may be conveniently produced in the successive overlapping voids.

34 Claims, 5 Drawing Sheets

METHOD AND APPARATUS FOR FORMING SUCCESSIVE OVERLAPPING VOIDS IN THE GROUND ALONG A PREDETERMINED COURSE OF TRAVEL AND FOR PRODUCING A SUBTERRANEAN WALL THEREIN

TECHNICAL FIELD OF THE INVENTION

The present invention relates generally to the formation of subterranean voids and walls and, more particularly, to a method and apparatus for producing successive overlapping voids in the ground along a predetermined course of travel so that a subterranean wall comprised of liquid impervious slurry material and/or contiguous structural elements may be accurately formed therein.

BACKGROUND OF THE INVENTION

It is frequently desirable and sometimes necessary to construct subterranean voids and walls. Subterranean walls are commonly used, for example, to insulate and protect a site (e.g., an environmental clean-up site, a construction site, etc.) from ground water seepage. Such walls are typically formed of slurry material (i.e., a gradually solidifying grout-like bonding agent which provides a liquid impervious shield) and/or structural elements (e.g., sheet metal pilings). Conventional slurry materials include cement, bentonite, and/or clay. Of course, a suitable subterranean void is needed to accommodate such a subterranean wall.

Various techniques for constructing subterranean walls are known in the art. A first, somewhat rudimentary, technique involves excavating a trench with a backhoe or the like, and then filling the trench with a barrier material, such as sheet metal pilings and/or slurry material, to produce a subterranean wall therein. A second, more advanced, technique involves driving a beam or mandrel into the ground to form a void, injecting slurry material into the void as the beam is extracted therefrom to fill the void, and then advancing the beam along the ground to a position where the beam overlaps a portion of the previously formed and filled void. This procedure is repeated until a desired length of successive overlapping voids is formed in the ground. Because the overlapping voids are immediately filled with slurry material, a subterranean slurry wall is produced therein.

Both of these techniques, however, suffer from noted deficiencies. The first is expensive, time consuming, and labor intensive, while the second is somewhat unreliable in terms of precision. More specifically, the second technique provides no reliable way to accurately guide the beam during successive beam insertions. As a consequence, the successive overlapping voids and the resulting slurry wall often deviate from the planned course of travel. The second technique is also inadequate for penetrating through dense soil layers.

OBJECTS AND SUMMARY OF THE INVENTION

Accordingly, a primary object of the present invention is to provide a method and apparatus for accurately forming successive overlapping voids in the ground along a predetermined course of travel.

A related object of the present invention is to provide a method and apparatus for constructing a uniform subterranean wall in the successive overlapping voids.

A more specific object of the present invention is to provide a method and apparatus for constructing a subterranean wall comprised of liquid impervious slurry material.

A related object of the present invention is to provide a method and apparatus for constructing a subterranean structural wall comprised of contiguous structural elements (e.g., interconnected sheet metal pilings).

A further related object of the present invention is to provide a method and apparatus for constructing a subterranean wall comprised of liquid impervious slurry material and contiguous structural elements.

Another object of the present invention is to provide a method and apparatus for forming successive overlapping voids through dense soil layers.

A related object of the present invention is to provide a method and apparatus for installing structural elements (e.g., sheet metal pilings) through dense soil layers.

A collateral object of the present invention is to provide a method and apparatus for insulating and protecting a site from ground water seepage.

Still another object of the present invention is to provide a method and apparatus having the foregoing characteristics which is dependable, durable, and convenient to use.

In accordance with these and other objects, a method and an apparatus is provided for forming successive overlapping voids in the ground along a predetermined course of travel and for producing a subterranean wall therein. The apparatus includes a mandrel for forming voids in the ground, and a pattern guide templet arranged on the ground for accurately guiding the mandrel along the predetermined course of travel during successive mandrel insertions. More specifically, the mandrel includes a plurality of downwardly projecting spaced-apart cutting teeth for facilitating penetration of the mandrel into the ground, and a plurality of downwardly projecting high pressure nozzles for discharging an injectable material (e.g., slurry material or water) into the ground as the mandrel is inserted therein. The pattern guide templet accurately receives and accommodates the cross-sectional shape of the mandrel during successive mandrel insertions so that successive overlapping voids are formed in the ground along the predetermined course of travel. The apparatus of the present invention further includes an installation rig for inserting structural elements into the successive overlapping voids formed by the mandrel. In this way, a subterranean wall comprised of liquid impervious slurry material and/or contiguous structural elements may be conveniently produced in the successive overlapping voids.

These and other objects, features, and advantages of the present invention will become apparent upon reading the following detailed description of the preferred embodiment, and upon reference to the accompanying drawings.

BRIEF DESCRIPTION OF THE DRAWINGS

In the drawings, wherein similar reference numerals denote similar elements throughout the several views.

While the present invention will be described and disclosed in connection with a preferred embodiment and procedure, it will be understood that we do not intend to limit our invention to what is shown and described. On the contrary, we intend to cover all such alternatives, modifications, and equivalents that fall within the spirit and scope of the present invention as defined by the appended claims.

DETAILED DESCRIPTION OF THE PREFERRED EMBODIMENT

Figure 1:
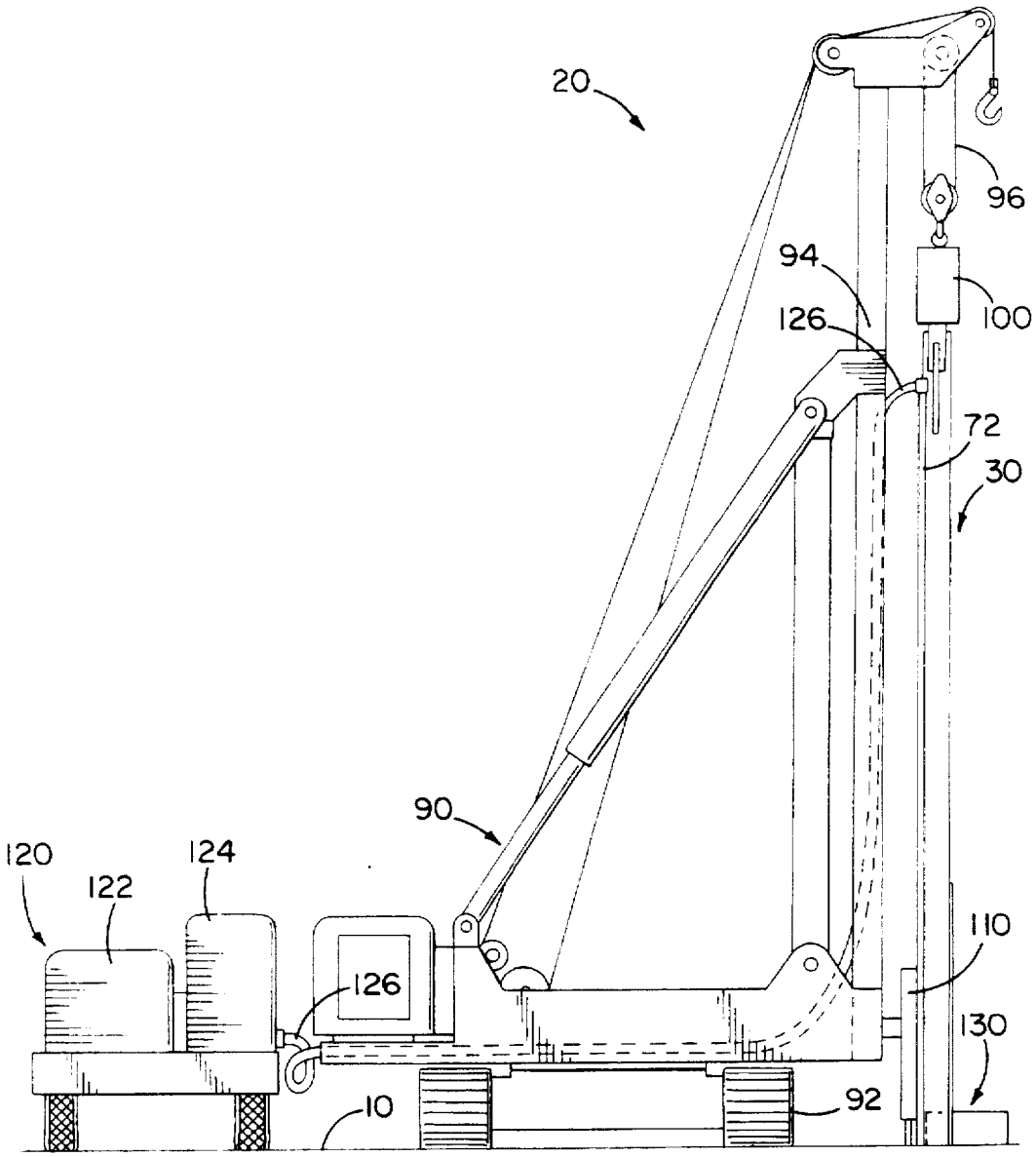
FIG. 1 is a side elevational view of an apparatus constructed in accordance with the teachings of the present invention for forming successive overlapping voids in the ground along a predetermined course of travel and for producing a subterranean wall therein.
Figure 6:
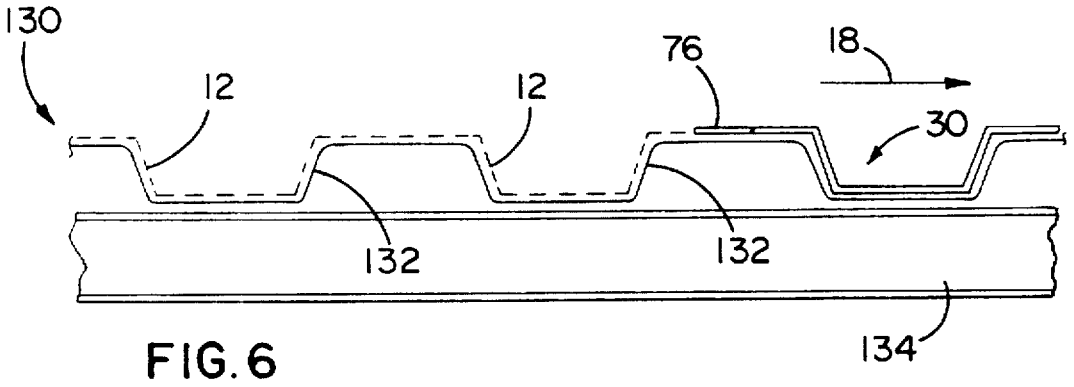
FIG. 6 is a top plan view of the pattern guide templet of the apparatus, shown receiving the mandrel.
Figure 7:
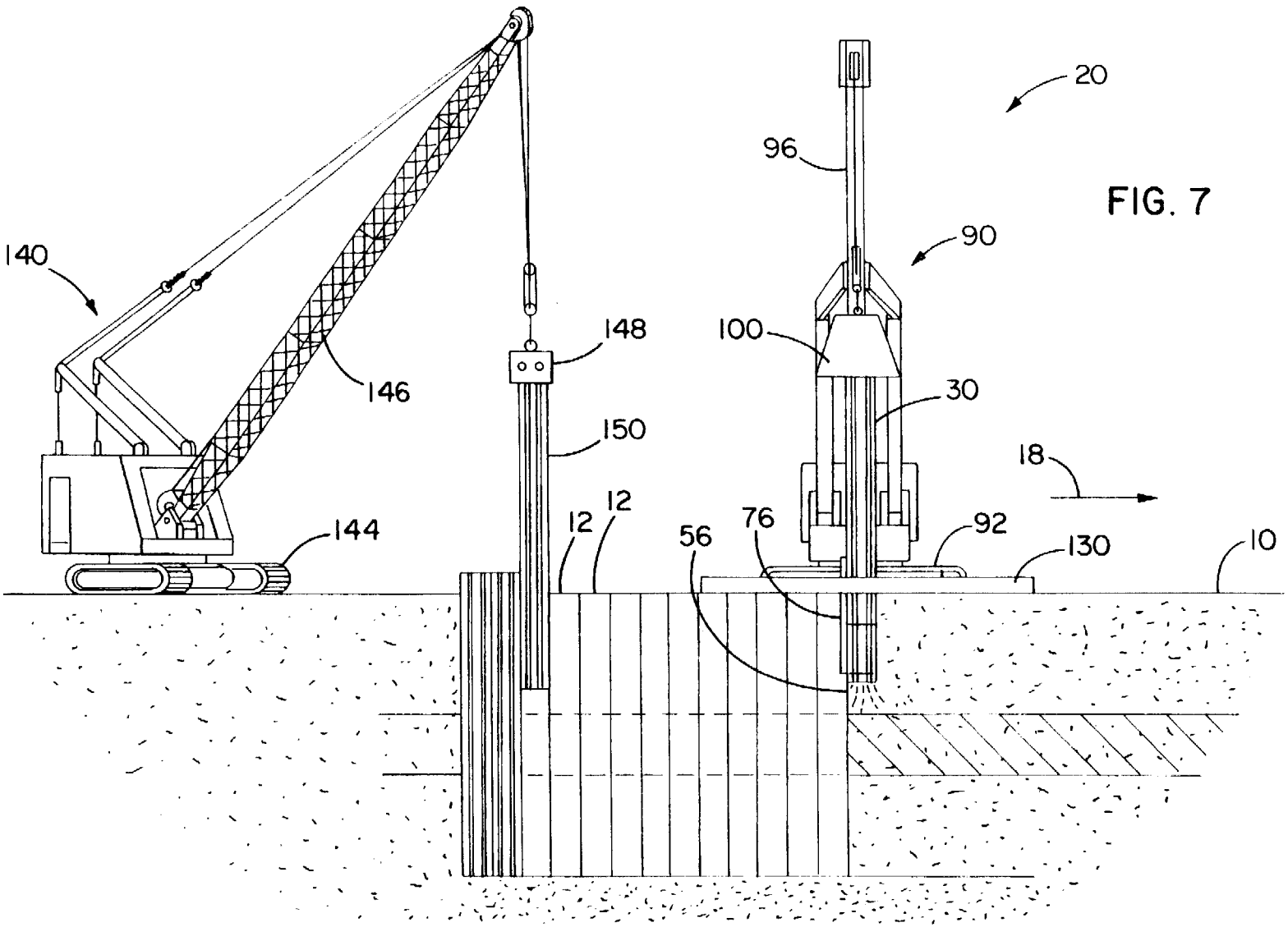
FIG. 7 is a schematic front view of the apparatus, shown forming successive overlapping voids in the ground along the predetermined course of travel and thereafter sequentially installing structural elements therein.
Figure 8:
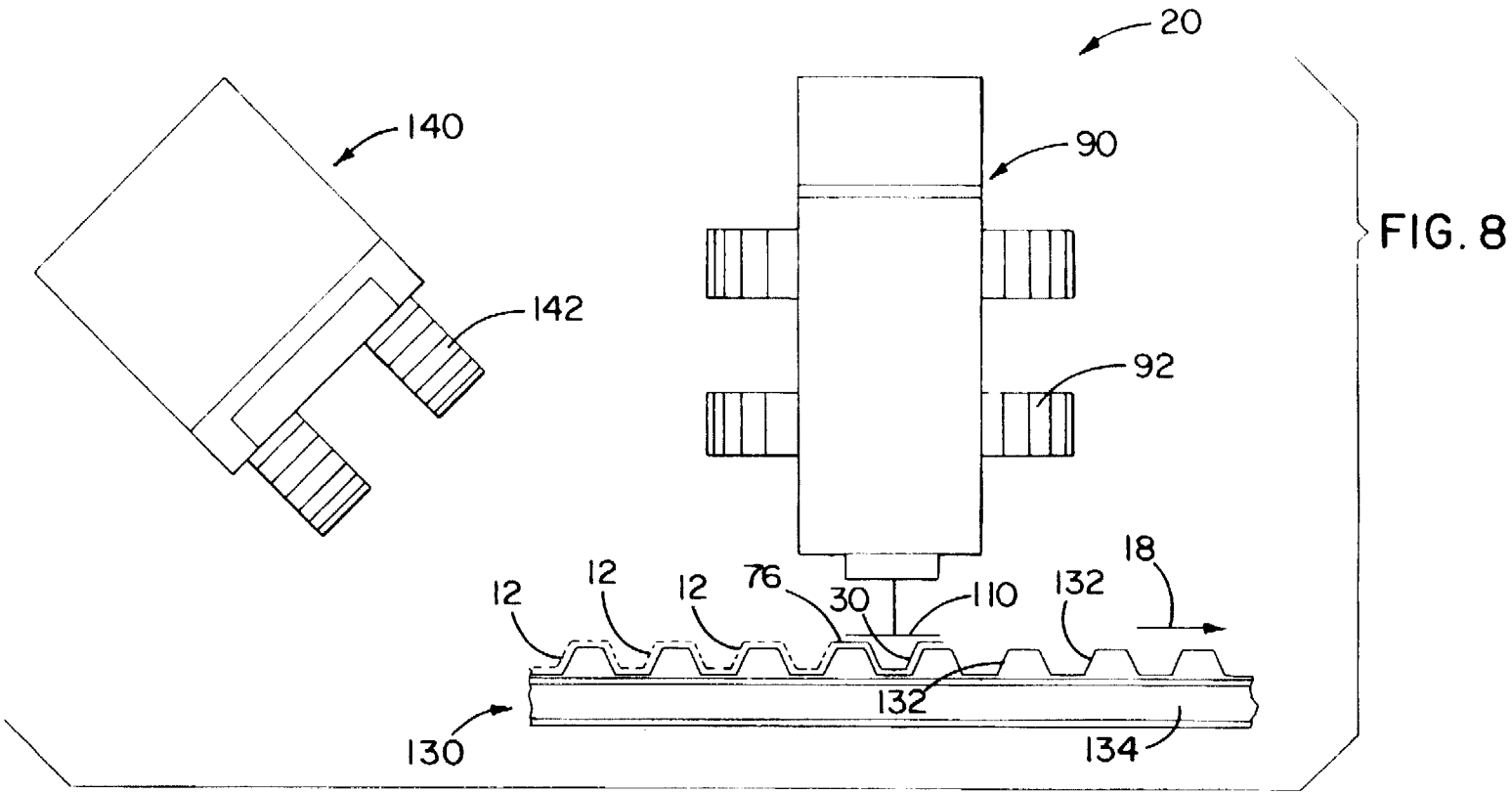
FIG. 8 is a schematic top plan view of the apparatus.

Referring now to the drawings, an apparatus constructed in accordance with the teachings of the present invention is generally designated by reference numeral 20, as shown, for example, in FIG. 1. In use, the apparatus 20 accurately forms successive overlapping voids 12 in the ground 10 along a predetermined course of travel 18, and also produces a subterranean wall comprised of liquid impervious slurry material and/or contiguous structural elements therein, as schematically illustrated in FIGS. 6–8. Such walls are frequently used, for example, to isolate environmental clean-up sites, and the like, from ground water seepage.

In accordance with certain objects of the present invention, the apparatus 20 includes a mandrel 30 which is inserted into the ground 10 to form voids or cavities, and a pattern guide templet 130 which accurately guides the mandrel 30 along the predetermined course of travel 18 during successive mandrel insertions. As best shown in FIG. 6, the pattern guide templet 130 comprises a plurality of repeating contours 132 attached to a stabilization member 134. Each repeating contour 132 is configured to receive and accommodate the mandrel 30.

In the illustrated embodiment, a crane 90 is provided for vertically supporting the mandrel 30 during each insertion. As best depicted in FIGS. 1, 7, and 8, the crane 90 is maneuverable along the ground 10 by crawler tracks 92 and includes a boom 94 and a hoist line 96. Suspended from the hoist line 96 is a vibratory driver 100 which is also coupled to the mandrel 30. In operation, the vibratory driver 100 applies a substantially vertical vibratory force to the mandrel 30 which causes the mandrel 30 to penetrate the ground 10. A guide support 110 attached to the crane 90 vertically aligns and slidably guides the mandrel 30 as the mandrel 30 is driven into the ground 10 by the vibratory driver 100.

As illustrated in FIGS. 2–5, the mandrel 30 of the present invention includes a top portion 32 which is attachable to the vibratory driver 100, and a bottom portion 42 which penetrates the ground 10. The top portion 32 of the mandrel 30 includes a clamping plate 34 which is releasibly attached to the vibratory driver 100 via a hydraulic clamp, or the like (not shown), while the bottom portion 42 includes a shoe 44. The mandrel 30 also has a length 64, a longitudinal axis 66, and a cross-sectional shape. In practice, the length 64 of the mandrel 30 is contingent upon the desired depth of the voids 12, but may be on the order of one-hundred feet or more.

Figure 2:
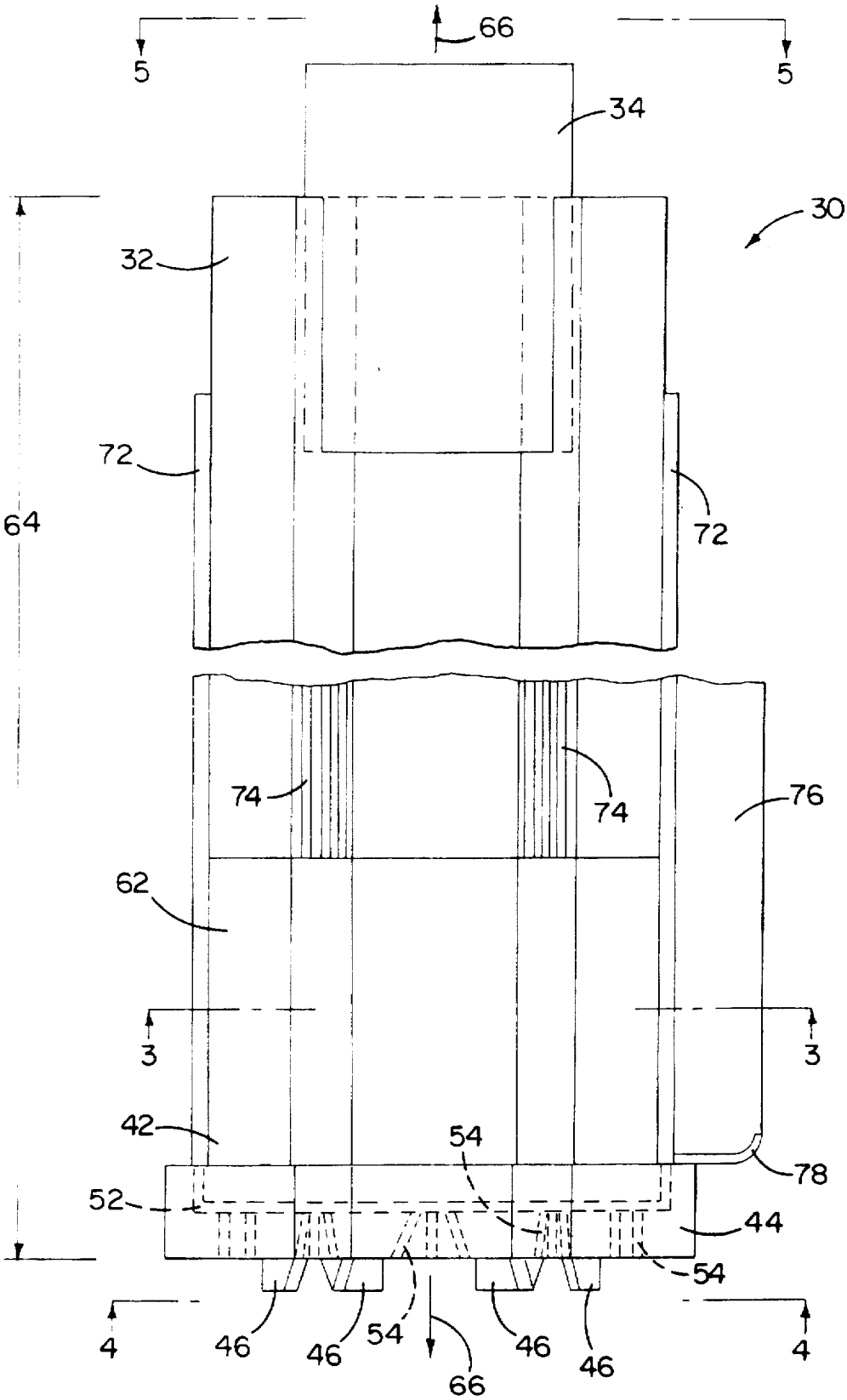
FIG. 2 is an enlarged fragmentary rear elevational view of the mandrel of the apparatus.
Figure 4:
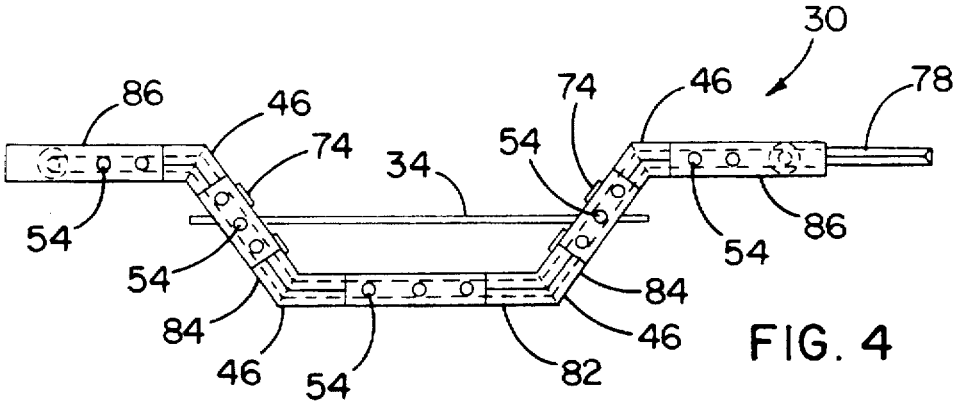
FIG. 4 is a bottom plan view of the mandrel, as seen in the direction of line 4—4 in FIG. 2.

In order to facilitate penetration of the mandrel 30 through the ground 10, the shoe 44 of the mandrel 30 includes a plurality of downwardly projecting cutting teeth 46. The cutting teeth 46 are preferably spaced-apart and include hardened surfaces for wear protection. The shoe 44 of the mandrel 30 also includes a plurality of downwardly projecting high pressure nozzles 54 for discharging injectable material (i.e., slurry material or water) into the ground 10 as the mandrel 30 is inserted therein. In the illustrated embodiment, the high pressure nozzles 54 are fluidically connected to a manifold or plenum 52 disposed within the shoe 44 which, in turn, is fluidically connected to high pressure piping 72 arranged on either side of the mandrel 30. As best shown in FIGS. 2 and 4, the high pressure nozzles 54 are disposed between the spaced-apart cutting teeth 46.

A pumping unit 120 is also provided for supplying pressurized injectable material to the high pressure piping 72 of the mandrel 30. As schematically depicted in FIG. 1, the pumping unit 120 includes a supply tank 122 which stores a quantity of injectable material, a pump 124 which pressurizes the injectable material, and a high pressure feed line 126 which fluidically connects the pumping unit 120 to the high pressure piping 72 of the mandrel 30. In use, pressurized injectable material is pumped from the supply tank 122 to the high pressure piping 72 of the mandrel 30 for subsequent discharge through the high pressure nozzles 54. Although the pumping unit 120 is illustrated as a separately maneuverable vehicle, it will be understood by those skilled in the art that the pumping unit 120 may alternatively be carried by or form a part of the crane 90.

In accordance with an important aspect of the present invention, the pumping unit 120 supplies injectable material at an extremely high pressure level (e.g., 3000–8000 psi) which is subsequently discharged through the high pressure nozzles 54 as the mandrel 30 is driven into the ground 10. In this way, a high pressure jetting action 56 is provided that erodes away soil in advance of the mandrel 30, as shown, for example, in FIG. 7. This high pressure jetting action 56, in conjunction with the vertical vibratory force provided by the vibratory driver 100 and the sharpness of the cutting teeth 46, facilitates penetration of the mandrel 30 through dense soil layers by breaking-up and/or pushing aside rocks, hard soil, and the like.

In order to provide a more effective high pressure jetting action 56, the high pressure nozzles 54 are disposed at dissimilar angles with respect to the longitudinal axis 66 of the mandrel 30, as shown, for example, in FIG. 2. In particular, some of the high pressure nozzles 54 are disposed substantially parallel to the longitudinal axis 66 of the mandrel 30, while others are disposed at an angle relative to the longitudinal axis 66 of the mandrel 30. In this way, a discharge spray that traverses substantially the entire cross-sectional shape of the mandrel 30 is advantageously provided.

Figure 5:
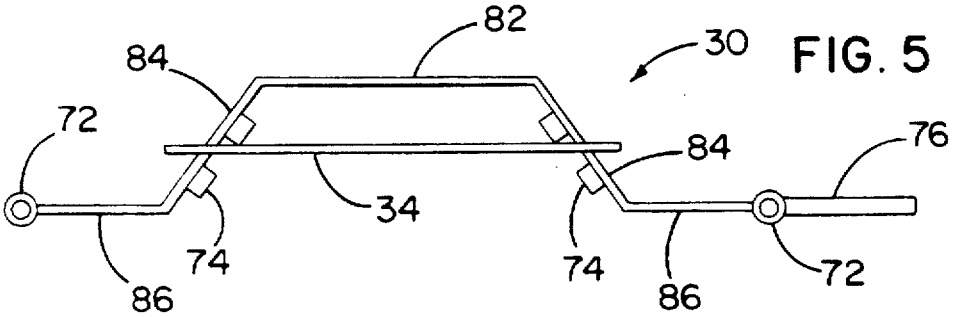
FIG. 5 is a top plan view of the mandrel, as seen in the direction of line 5—5 in FIG. 2.

In the illustrated embodiment, the mandrel 30 has a cross-sectional shape which is substantially channel-like in configuration. More specifically, the mandrel 30 includes a generally flat central portion 82, sloping side portions 84, and outer edge portions 86. As shown in FIGS. 4 and 5, the sloping side portions 84 are disposed at an angle relative to the central portion 82, and the outer edge portions 86 are substantially parallel to the central portion 82. Although a channel-shaped mandrel 30 is specifically described and illustrated herein, it will be appreciated by those skilled in the art that other shapes may alternatively be used, provided they substantially match the repeating contours 132 of the pattern guide templet 130.

Preferably, the mandrel 30 is formed of a high-grade steel that is fabricated or cast to shape. In this way, the mandrel 30 has a substantially unitary construction. Although a steel mandrel 30 having a substantially unitary construction is specifically described herein, it will be appreciated by those skilled in the art that other constructions could alternatively be employed. For example, the mandrel 30 could be comprised of two separately shaped pieces that are welded together in the middle of the central portion 82 such that a weld disposed substantially parallel to the longitudinal axis 66 of the mandrel 30 runs along the full length 64 of the mandrel 30.

In order to provide added strength, stiffness, and durability to the mandrel 30, a structural cover plate 62 is welded to either side of the bottom portion 42. In addition, a plurality of structural bars 74 are also welded to the sloping side portions 84. In the illustrated embodiment, the structural cover plate 62 abuts the shoe 44 and extends upwardly therefrom, as shown in FIG. 2. The structural bars 74 extend upwardly from the structural cover plate 62 and are disposed substantially parallel to the longitudinal axis 66 of the mandrel 30.

The mandrel 30 of the present invention also includes a rigid guide fin 76. As shown in FIGS. 2–5, the rigid guide fin 76 extends upwardly from the bottom portion 42 of the mandrel 30 and projects outwardly from one of the outer edge portions 86. In FIG. 6, the mandrel 30 is shown oriented 180° with respect to FIG. 5 such that the rigid guide fin 76 extends rearwardly from the predetermined course of travel 18. In use, the rigid guide fin 76 is placed within a previously formed void, as shown, for example, in FIGS. 6 and 8, such that it partially overlaps the void formed in the ground 10 during the previous mandrel insertion. In this way, the rigid guide fin 76 assures continuity between the successive overlapping voids 12. Preferably, the rigid guide fin 76 has a relatively long length (e.g., approximately one-third the length 64 of the mandrel 30), and includes a sharp edge portion 78 which facilitates penetration of the mandrel 30 into the ground 10. The relatively long length of the rigid guide fin 76 not only provides increased lateral support to the mandrel 30, but also facilitates proper alignment of the mandrel 30 as it is inserted into the ground 10.

In accordance with certain objects of the present invention, the injectable material supplied by the pumping unit 120 may either be water or slurry material (i.e., a hardenable grout-like bonding agent which provides a liquid impervious shield). If water is used, the successive overlapping voids 12 formed by the mandrel 30 will either be substantially empty or substantially water-filled, depending upon the drainage of the soil. If, however, slurry material is used, the successive overlapping voids 12 will be substantially slurry-filled because slurry material is too viscous to flow through the soil. Of course, in order to completely fill the voids 12, it may be necessary to continue to discharge slurry material as the mandrel 30 is extracted from the ground 10. In any event, the successive overlapping slurry-filled voids 12 will produce a liquid impervious subterranean slurry wall which, in time, will gradually harden or set. By way of example, a typical slurry material gels after about four hours, semi-hardens overnight, and fully strengthens into a paste after a couple of weeks. Slurry materials that are suitable for use with the present invention include: (1) cement and water; (2) cement, bentonite and water; and (3) clay, cement, and water.

In keeping with another important aspect of the present invention, the repeating contours 132 of the pattern guide templet 130 are adapted to individually receive and accommodate the cross-sectional shape of the mandrel 30 during successive mandrel insertions, as depicted, for example, in FIGS. 6 and 8. In other words, each repeating contour 132 has a shape which is substantially similar or complemental to the cross-sectional shape of the mandrel 30. In this way, the mandrel 30 is conveniently placed within the repeating contours 132 during successive mandrel insertions.

In use, the stabilization member 134 of the pattern guide templet 130 is anchored to the ground 10 along the predetermined course of travel 18, while the repeating contours 132 receive the mandrel 30 during successive insertions. In particular, after the mandrel 30 has been received by one of the repeating contours 132, the mandrel 30 is driven into the ground 10 to form a void therein. Upon extraction, the mandrel 30 is advanced along the pattern guide templet 130 into an adjacent repeating contour 132 (by moving the crane 90 in a direction substantially parallel to the predetermined course of travel 18) such that the rigid guide fin 76 of the mandrel 30 partially overlaps the previously formed void, as shown, for example, in FIGS. 6–8. The mandrel 30 is then re-inserted into the ground 10 to form a subsequent void therein. By repeating these steps, a desired number of successive overlapping voids 12 may be accurately formed in the ground 10 along the predetermined course of travel 18. Although the predetermined course of travel 18 shown in FIGS. 6–8 is a substantially a straight line, it will be appreciated by those skilled in the art that the pattern guide templet 130 of the present invention may be modified to conform to any predetermined course of travel (e.g., curved, circular, angled, etc.).

In accordance with certain objects of the present invention, the apparatus 20 further includes an installation rig 140 for inserting structural elements 150 into the successive overlapping voids 12 that were previously formed by the mandrel 30. In the illustrated embodiment, the installation rig 140 is a conventional pile driver (see, e.g., FIGS. 7 and 8), and the structural elements 150 are sheet metal pilings (see, e.g., FIG. 9). More specifically, the pile driver includes a crane 142 with crawler tracks 144 and a pivotally mounted boom 146. A vibratory unit 148 suspended from the boom 146 is used to drive structural elements 150 into the voids 12. As a safety precaution, the crane 142 of the installation rig 140 and the crane 90 supporting the mandrel 30 are spaced apart, preferably by a distance of at least forty feet.

In operation, the installation rig 140 sequentially installs structural elements 150 into the successive overlapping voids 12 to produce a subterranean structural wall therein, as depicted, for example, in FIG. 7. Of course, prior to installation, the voids 12 may be substantially empty, substantially water-filled, or substantially slurry-filled, depending upon the drainage of the soil and the injectable material used to form the voids 12. As a consequence, the injectable material not only determines the content of the voids 12, but also dictates the substance of the resulting subterranean wall. For example, if water is used as the injection material, the voids 12 will either be substantially empty or substantially water-filled prior to installation, and the resulting subterranean wall will be comprised exclusively of contiguous structural elements. If, on the other hand, slurry material is used as the injection material, the voids 12 will be substantially slurry-filled prior to installation, and the resulting subterranean wall will be comprised of both contiguous structural elements and liquid impervious slurry material. In practice, the structural elements 150 are driven through the slurry-filled voids 12. Of course, in order to minimize installation resistance, the structural elements 150 should be inserted into the voids 12 before the slurry material has an opportunity to set or harden appreciably.

Figure 3:
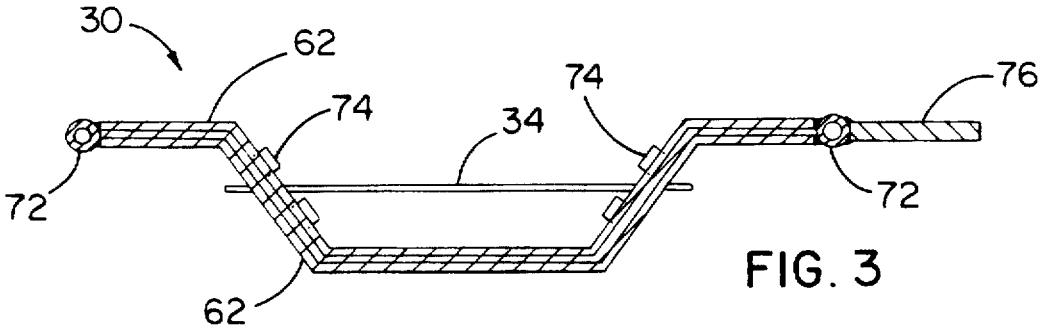
FIG. 3 is a cross-sectional view of the mandrel, as seen in the direction of line 3—3 in FIG. 2.
Figure 9:
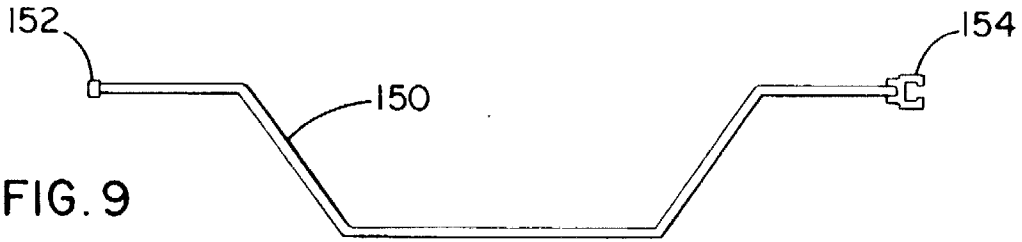
FIG. 9 is an enlarged top plan view of an exemplary structural element.

In order to facilitate insertion of the structural elements 150 into the voids 12, each structural element 150 has a cross-sectional shape which is substantially similar to the cross-sectional shape of the mandrel 30 (e.g., compare FIGS. 3 and 4 with FIG. 9). The structural elements 150 are also advantageously provided with interlocking edge portions (i.e., a male coupling 152 and a female coupling 154) which facilitate the construction of contiguous subterranean structural walls. For example, after a first structural element has been installed into a first void 12, a second structural element is aligned with and connected to the first structural element via the interlocking edge portions before it is installed into a second adjacent void. In this way, a contiguous subterranean structural wall comprised of interconnected structural elements 150 may be conveniently produced in the successive overlapping voids 12.

We claim:

1. Apparatus for forming successive overlapping voids in the ground along a predetermined course of travel to facilitate the construction of a continuous subterranean wall therein, which comprises:

a mandrel for forming voids in the ground, the mandrel having a length, a longitudinal axis, a cross-sectional shape, a top portion which is attachable to a vibratory driver, and a bottom portion which penetrates the ground, a plurality of high pressure nozzles for discharging an injectable material into the ground as the mandrel is inserted therein, the injectable material being supplied to the high pressure nozzles through high pressure piping arranged at least partially along the length of the mandrel; and a pattern guide templet arranged on the ground for accurately guiding the mandrel along the predetermined course of travel during successive mandrel insertions into and subsequent withdrawals from the ground, the pattern guide templet having a plurality of adjacently disposed and similarly-configured repeating contours, each repeating contour having a shape which is substantially similar to the cross-sectional shape of the mandrel, the repeating contours receiving and accommodating the cross-sectional shape of the mandrel and no other structural elements during successive mandrel insertions and withdrawals so that successive overlapping voids are formed in the ground along the predetermined course of travel.

2. The apparatus as set forth in claim 1, wherein the bottom portion of the mandrel includes a plurality of spaced-apart cutting teeth for facilitating penetration of the mandrel into the ground.

3. The apparatus as set forth in claim 1, wherein the injectable material comprises a hardenable slurry material which fills the successive overlapping voids to form a liquid impervious subterranean slurry wall.

4. The apparatus as set forth in claim 1, further comprising:

a vibratory driver attached to the top portion of the mandrel;

a crane for vertically supporting the vibratory driver and the attached mandrel;

a guide support connected to the crane for vertically aligning and slidably guiding the mandrel as it penetrates the ground; and a pumping unit for supplying pressurized injectable material to the high pressure piping.

5. The apparatus as set forth in claim 1, further comprising:

an installation rig for inserting structural elements into the successive overlapping voids formed by the mandrel.

6. The apparatus as set forth in claim 5, wherein the installation rig is a pile driver.

7. The apparatus as set forth in claim 5, wherein the injectable material comprises a hardenable slurry material which fills the successive overlapping voids.

8. The apparatus as set forth in claim 7, wherein the installation rig inserts the structural elements into the successive overlapping slurry-filled voids to form a subterranean wall comprised of contiguous structural elements and liquid impervious slurry material.

9. The apparatus as set forth in claim 5, wherein the injectable material comprises water.

10. The apparatus as set forth in claim 9, wherein the installation rig inserts the structural elements into the successive overlapping voids to form a subterranean wall comprised of contiguous structural elements.

11. The apparatus as set forth in claim 5, wherein each structural element has a cross-sectional shape which is substantially similar to the cross-sectional shape of the mandrel.

12. The apparatus as set forth in claim 5, wherein each structural element comprises a sheet metal piling.

13. The apparatus as set forth in claim 5, wherein each structural elements includes interlocking edge portions.

14. The apparatus as set forth in claim 1, wherein the cross-sectional shape of the mandrel is in the form of a channel and includes a central portion, sloping side portions which are disposed at an angle relative to the central portion, and outer edge portions which are substantially parallel to the central portion.

15. The apparatus as set forth in claim 1, wherein the mandrel includes a rigid guide fin which extends upwardly from the bottom portion of the mandrel and projects outwardly in a direction substantially parallel to the predetermined course of travel, the rigid guide fin being adapted to partially overlap the void formed in the ground during a previous mandrel insertion to facilitate proper alignment of the mandrel.

16. The apparatus as set forth in claim 15, wherein the rigid guide fin has a length which is approximately equal to one-third the length of the mandrel.

17. The apparatus as set forth in claim 1, wherein at least some of the high pressure nozzles are disposed at an angle relative to the longitudinal axis of the mandrel.

18. The apparatus as set forth in claim 1, wherein the injectable material is discharged from the high pressure nozzles at a pressure of at least 3000 psi.

19. The apparatus as set forth in claim 2, wherein the cutting teeth include hard surfaces for wear protection.

20. Apparatus for forming successive overlapping cavities in the ground along a predetermined course of travel to facilitate the construction of a continuous subterranean wall therein, which comprises:

a crane having a boom and a hoist line;

a vibratory driver attached to the hoist line of the crane;

a mandrel for forming cavities in the ground, the mandrel having a length, a cross-sectional shape, a top portion which is attached to the vibratory driver, and a bottom portion which penetrates the ground, the vibratory driver applying a substantially vertical vibratory force to the top portion of the mandrel so as to drive the mandrel into the ground, the bottom portion of the mandrel including a plurality of spaced-apart cutting teeth for facilitating penetration of the mandrel into the ground and a plurality of high pressure nozzles for discharging injectable material into the ground as the mandrel is inserted therein, the mandrel also including high pressure piping arranged at least partially along the length of the mandrel for supplying injectable material to the high pressure nozzles;

a pumping unit for supplying pressurized injectable material to the high pressure piping of the mandrel;

a guide support connected to the boom of the crane for vertically aligning and slidably guiding the mandrel as the mandrel penetrates the ground; and a pattern guide templet arranged on the ground for accurately guiding the mandrel along the predetermined course of travel during successive mandrel insertions into and subsequent withdrawals from the ground, the pattern guide templet having a plurality of adjacently disposed and similarly-configured repeating contours, each repeating contour having a shape which is substantially similar to the cross-sectional shape of the mandrel, the repeating contours receiving and accommodating the cross-sectional shape of the mandrel and no other structural elements during successive mandrel insertions and withdrawals so that successive overlapping cavities are accurately formed in the ground along the predetermined course of travel.

21. The apparatus as set forth in claim 20, further comprising:

an installation rig for driving structural elements into the successive overlapping cavities formed by the mandrel so that a subterranean structural wall is produced therein.

22. The apparatus as set forth in claim 20, wherein the injectable material comprises a hardenable slurry material which solidifies over time to form a liquid impervious shield.

23. The apparatus as set forth in claim 20, wherein the injectable material comprises water.

24. A method of forming successive overlapping voids in the ground along a predetermined course of travel to facilitate the construction of a continuous subterranean wall therein, the method comprising the steps of:

(a) arranging a pattern guide templet having a plurality of adjacently disposed and similarly-configured repeating contours along the predetermined course of travel;

(b) positioning a mandrel having a cross-sectional shape which is substantially similar to the shape of the repeating contours of the pattern guide templet and a plurality of downwardly projecting high pressure nozzles within one of the repeating contours of the pattern guide templet;

(c) driving the mandrel and no other structural elements into the ground so as to form a void therein by applying a substantially vertical vibratory force to the mandrel and concurrently discharging an injectable material under high pressure through the high pressure nozzles;

(d) extracting the mandrel from the ground;

(e) advancing the mandrel along the pattern guide templet to an adjacent repeating contour such that the mandrel partially overlaps the void formed in the ground during step (c); and (f) repeating steps (c) through (e) to form successive overlapping voids in the ground along the predetermined course of travel.

25. The method as set forth in claim 24, wherein the step of arranging the mandrel along the predetermined course of travel comprises positioning the mandrel along a substantially straight line.

26. The method as set forth in claim 24, wherein the step of driving the mandrel into the ground to form a void therein and concurrently discharging an injectable material comprises discharging a hardenable slurry material to fill the void therewith.

27. The method as set forth in claim 24, further comprising the step of:

(f) installing structural elements into the successive overlapping voids.

28. The method as set forth in claim 27, further comprising the step of:

filling the successive overlapping voids with a hardenable slurry material to form a liquid impervious subterranean slurry wall therein.

29. The method as set forth in claim 28, further comprising the step of:

inserting structural elements into the successive overlapping slurry-filled voids to form a subterranean wall comprised of contiguous structural elements and liquid impervious slurry material.

30. The method as set forth in claim 27, wherein the step of concurrently discharging an injectable material comprises discharging water.

31. The method as set forth in claim 30, further comprising the step of:

inserting structural elements into the successive overlapping voids to form a subterranean wall comprised of contiguous structural elements.

32. A method of forming successive overlapping cavities in the ground along a predetermined course of travel and for producing a subterranean wall comprised of contiguous structural elements therein, the method comprising the steps of:

(a) arranging a pattern guide templet having a plurality of adjacently disposed and similarly-configured repeating contours on the ground along the predetermined course of travel;

(b) positioning a mandrel having a cross-sectional shape which is substantially similar to the shape of the repeating contours of the pattern guide templet and a plurality of downwardly projecting high pressure nozzles into one of the repeating contours of the pattern guide templet;

(c) substantially vertically aligning the mandrel;

(d) driving the mandrel into the ground so as to form a cavity therein by applying a substantially vertical vibratory force to the mandrel and concurrently discharging an injectable material under high pressure through the high pressure nozzles;

(e) extracting the mandrel from the ground while continuing to discharge injectable material through the high pressure nozzles;

(f) advancing the mandrel along the pattern guide templet to an adjacent repeating contour such that the mandrel partially overlaps the cavity formed in the ground during step (d);

(g) repeating steps (c) through (f) to form successive overlapping cavities in the ground along the predetermined course of travel; and (h) sequentially installing structural elements into the successive overlapping cavities to produce a subterranean wall comprised of contiguous structural elements therein.

33. The method as set forth in claim 32, wherein the step of driving the mandrel into the ground so as to form a cavity therein and concurrently discharging an injectable material comprises driving the mandrel into the ground and concurrently discharging a slurry material.

34. The method as set forth in claim 32, wherein the step of driving the mandrel into the ground so as to form a cavity therein and concurrently discharging an injectable material comprises driving the mandrel into the ground and concurrently discharging water.

* * * * *